US008426026B2

(12) United States Patent
Qi et al.

(10) Patent No.: US 8,426,026 B2
(45) Date of Patent: Apr. 23, 2013

(54) INTERMEDIATE TRANSFER MEMBER COMPRISING A TOUGHENED FLUOROPLASTIC COMPOSITE SURFACE LAYER

(75) Inventors: Yu Qi, Oakville (CA); Nan-Xing Hu, Oakville (CA); Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/755,538

(22) Filed: Apr. 7, 2010

(65) Prior Publication Data

US 2011/0250439 A1 Oct. 13, 2011

(51) Int. Cl.
*G03G 15/16* (2006.01)

(52) U.S. Cl.
USPC ..... 428/421; 428/367; 428/297.4; 399/302; 977/742

(58) Field of Classification Search ..... None
See application file for complete search history.

(56) References Cited

U.S. PATENT DOCUMENTS

| | | | | |
|---|---|---|---|---|
| 5,671,472 | A * | 9/1997 | Snelling | 399/308 |
| 7,991,340 | B2 * | 8/2011 | Qi et al. | 399/333 |
| 2005/0118372 | A1 * | 6/2005 | Bonnet et al. | 428/35.7 |
| 2007/0110982 | A1 * | 5/2007 | Plissonnier et al. | 428/300.1 |
| 2008/0038566 | A1 * | 2/2008 | Cody et al. | 428/457 |
| 2008/0152895 | A1 * | 6/2008 | Law | 428/323 |
| 2011/0014466 | A1 * | 1/2011 | Hu et al. | 428/367 |

OTHER PUBLICATIONS

Monner HP, "Classic" and Emerging Smart Materials and their Applications, 2006, Multifunctional Structures/Integration of Sensors and Antennas, RTO-MP-AVT-141, pp. KN2-1-KN2-18.* http://www.surface-tension.de/solid-surface-energy.htm, Solid surface energy data (SFE) for common polymers, Nov. 20, 2007, pp. 1-2.*

Polymers, a Properties Database, http://www.polymersdatabase.com/entry.do?id=264&exno=264&method=view&si=POLY, relevant data compiled from the following reference: Silverstein MS, Film Formation in HFP Plasmas, ACS Symp Ser, 1996, vol. 648, p. 465.*

Silverstein MS, Film Formation in HFP Plasmas, ACS Symp Ser, 1996, vol. 648, p. 465.*

Dyneon, Dyneon Fluoroplastics Product Comparison Guide, 2003, Dyneon LLC, pp. 1-7.*

* cited by examiner

*Primary Examiner* — Callie Shosho
*Assistant Examiner* — Patrick English
(74) *Attorney, Agent, or Firm* — MH2 Technology Law Group LLP

(57) ABSTRACT

Exemplary embodiments provide an intermediate transfer member used for electrophotographic devices, wherein an outermost layer of the intermediate transfer layer can include a plurality of fluoroelastomer-coated carbon nanotubes dispersed in a fluoroplastic matrix to provide desirable surface properties useful for the intermediate transfer member.

17 Claims, 3 Drawing Sheets

INTERMEDIATE TRANSFER MEMBER COMPRISING A TOUGHENED FLUOROPLASTIC COMPOSITE SURFACE LAYER

DETAILED DESCRIPTION

1. Field of Use

The present teachings relate generally to intermediate transfer members used for electrophotographic devices and, more particularly, to intermediate transfer members including a toughened fluoroplastic composite surface layer.

2. Background

Multi-layer intermediate transfer members with each layer having specific functions are desirable for electrophotographic imaging processes and machines, especially for high speed machines.

One type of conventional multi-layer intermediate transfer member includes two layers of polyimide, with the upper polyimide having a high-resistivity and the lower polyimide having a low-resistivity. Another type of conventional multi-layer intermediate transfer member includes a polyimide base layer and a fluorine resin surface layer on the polyimide base layer. A third type of conventional multi-layer intermediate transfer member includes a three-layer configuration having an elastic layer disposed between a polyimide base layer and a fluorine resin surface layer.

In these conventional multi-layer configurations, the mechanically robust polyimide base layer provides structural integrity to the intermediate transfer member, while the surface layer imparts additional functions. For example, a surface layer with low surface energy is desirable for efficient toner cleaning of the intermediate transfer layer.

Fluoroplastic materials are known with low surface energy and with chemical and thermal stability. These properties are desirable for intermediate transfer members. However, fluoroplastic materials are semi-crystalline materials, and are prone to ductile failure due to their inherent brittleness.

Thus, there is a need to overcome these and other problems of the prior art and to provide a non-brittle or toughened fluoroplastic material used as an outermost layer of intermediate transfer members providing desirable surface properties.

SUMMARY

According to various embodiments, the present teachings include an intermediate transfer member that has a substrate and an outermost layer disposed over the substrate. The outermost layer can include a fluoroplastic matrix and a plurality of fluoroelastomer-coated carbon nanotubes dispersed in the fluoroplastic matrix. The outermost layer can have a surface resistivity ranging from about $10^9$ ohms/sq to about $10^{13}$ ohms/sq.

According to various embodiments, the present teachings also include an intermediate transfer member. The intermediate transfer member can have an outermost layer disposed over an exemplary polyimide substrate. The outermost layer can further include a plurality of fluoroelastomer-coated carbon nanotubes dispersed in a fluoroplastic matrix to provide the outermost layer a surface energy of less than about 25 mN/m.

According to various embodiments, the present teachings further include an image forming apparatus that includes an imaging member disposed to allow an intermediate transfer member to transfer a developed toner image from the imaging member to a print medium. In this apparatus, the intermediate transfer member can include an outermost layer disposed over a substrate. The outermost layer can include a plurality of fluoroelastomer-coated carbon nanotubes dispersed in a fluoroplastic matrix. The outermost layer can have a surface resistivity ranging from about $10^9$ ohms/sq to about $10^{13}$ ohms/sq and a surface energy of less than about 25 mN/m.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Exemplary embodiments provide an intermediate transfer member used in electrophotographic devices. The intermediate transfer member can be used to receive and transfer a developed toner image from an imaging member to a print medium. In embodiments, the intermediate transfer member can include a substrate and an outermost layer disposed over the substrate. The outermost layer can include a plurality of fluoroelastomer-coated carbon nanotubes dispersed in a fluoroplastic matrix to provide desirable surface properties useful for the intermediate transfer member. In embodiments, one or more other functional layers can be disposed between the substrate and the outermost layer.

Generally, in an electrophotographic reproducing apparatus, a light image of an original to be copied can be recorded in the form of an electrostatic latent image upon an imaging member, for example, a photosensitive member. The latent image can be subsequently rendered visible by the application of electroscopic thermoplastic resin particles, commonly referred to as toner.

Figure 1:
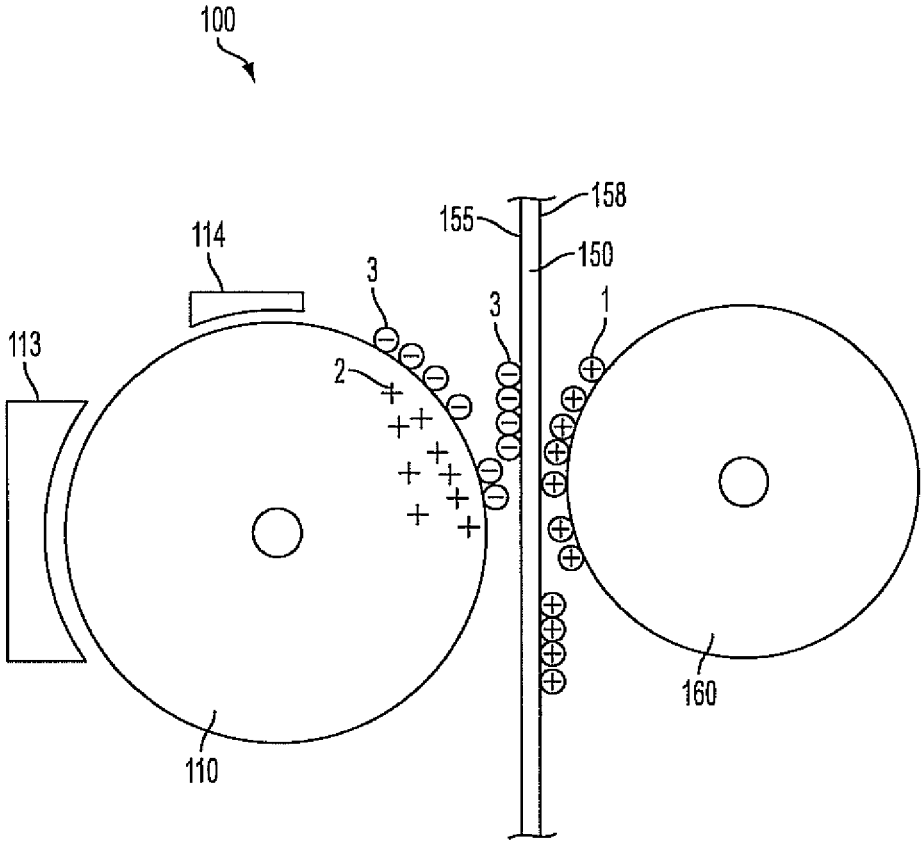
FIG. 1 depicts an exemplary image development system in accordance with various embodiments of the present teachings.

FIG. 1 depicts an exemplary image development system 100 using an intermediate transfer member in accordance with various embodiments of the present teachings. Specifically, as shown in FIG. 1, an imaging member 110 can be image-wisely exposed to light from an optical system or an image input apparatus 113, for example, a laser or light emitting diode, to form an electrostatic latent image thereon. The electrostatic latent image can then be developed by bringing a developer mixture from a developer station 114 into contact with. Development can be effected by use of a magnetic brush, powder cloud, or other known development process.

After the toner particles have been deposited or developed on the surface of the photoconductive imaging member 110, they can be transferred to a print medium, for example, a copy sheet, by a pressure transfer or an electrostatic transfer (not shown). Alternatively, as shown in FIG. 1, the developed image can be transferred to an intermediate transfer member 150 and subsequently transferred to the exemplary copy sheet, followed by a fusing process to fix the transferred toner image on the copy sheet, thereby forming a permanent image.

In embodiments, the intermediate transfer member 150 can be positioned between the imaging member 110 and a transfer member 160. For example, subsequent to the development, charged toner particles 3 from the developer station 114 can be attracted and held by the imaging member 110, because the imaging member 110 possesses a charge 2 opposite to that of the toner particles 3. Note that although the toner particles are shown as negatively charged and the imaging member 110 are shown as positively charged in FIG. 1, these charges can be reversed, depending on the nature of the toner and the machinery being used. In some embodiments, the toner can be present in a liquid developer. In other embodiments, dry development systems can be used.

In embodiments, the intermediate transfer member 150 can be charged with a positive charge by, for example, a biased transfer roll, a corona or any other charging mechanism having a higher voltage than the surface of the imaging member 110. The negatively charged toner particles 3 can be attracted to the front side 155 of the intermediate transfer member 150 by the positive charge 1 on the backside 158 of the intermediate transfer member 150.

After the developed toner image has been transferred from the imaging member 110 to the intermediate transfer member 150, the intermediate transfer member 150 can be contacted under heat and/or pressure to the print medium. The toner image on the intermediate transfer member 150 can then be transferred to the print medium.

As disclosed herein, although the imaging member 110 is exemplified by a photoreceptor drum in FIG. 1, one of ordinary skill in the art would understand that other electrophotographic imaging receptors such as ionographic belts and drums, electrophotographic belts, and the like can also be used in accordance with various embodiments of the present teachings.

In embodiments, the intermediate transfer member 150 can be in a multi-layer configuration in a form of, for example, a sheet, a film, a web, a foil, a strip, a coil, a cylinder, a drum, a drelt, a roll, an endless strip, a circular disc, a belt including an endless belt, an endless seamed flexible belt, an endless seamless flexible belt, an endless belt having a puzzle cut seam, and the like. For example, the intermediate transfer member 150 can be an endless seamed flexible belt or seamed flexible belt.

Figure 2A:
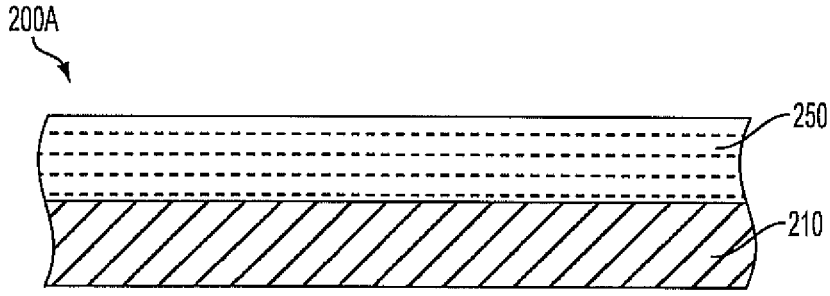
FIGS. 2A-2C depict a portion of various exemplary intermediate transfer members used for the system of FIG. 1 in accordance with various embodiments of the present teachings.
Figure 2B:
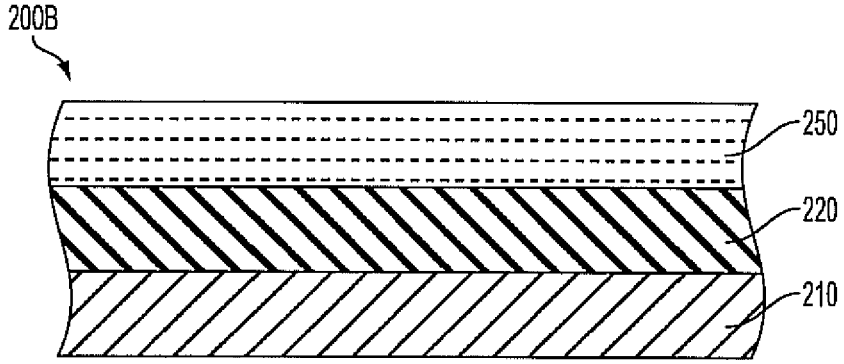
Figure 2C:
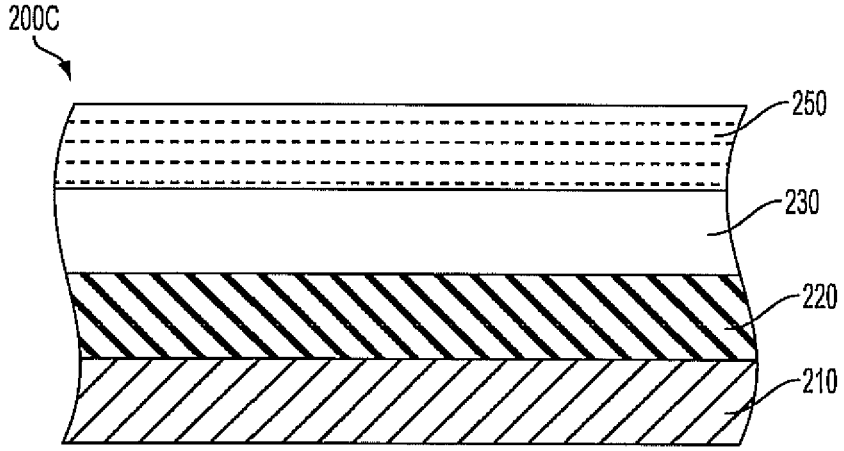

FIGS. 2A-2C depict a portion of various exemplary intermediate transfer members 200A-C in accordance with various embodiments of the present teachings.

The exemplary multi-layer intermediate transfer members 200A-C can include an outermost layer 250 disposed over a substrate 210. In embodiments, one or more functional layers can be disposed between the outermost layer 250 and the substrate 210.

For example, FIG. 2A depicts a two-layer configuration for the intermediate transfer member 200A, while FIG. 2B depicts a three-layer configuration for the intermediate transfer member 200B and FIG. 2C depicts a four-layer configuration for the intermediate transfer member 200C.

As shown in FIG. 2B, a resilient layer 220 can be disposed between the outermost layer 250 and the substrate 210. For example, the resilient layer 220 can have a thickness ranging from about 3 microns to about 500 microns, or from about 15 microns to about 250 microns, or from about 25 microns to about 100 microns. In embodiments, the resilient layer 220 can be made of, for example, silicone materials as known to one of ordinary skill in the art. Examples of the silicone materials can include fluorosilicones and silicone rubbers, such as silicone rubber 552 available from Sampson Coatings (Richmond, Va.).

As shown in FIG. 2C, an intermediate layer 230, for example, can be disposed on the exemplary resilient layer 220 that is disposed on the substrate 210.

In embodiments, various additional layers, for example, adhesive layers, can further be formed between the substrate 210 and the outermost layer 250.

In embodiments, the substrate 210 of the intermediate transfer member 200A-C or 150 in FIG. 1 can be made of a material including, but not limited to, polyimide, polyamideimide, polyetherimide, and a combination thereof. In embodiments, the substrate 210 of the intermediate transfer member can be in a form of, for example, a sheet, a film, a web, a foil, a strip, a coil, a cylinder, a drum, a drelt, a roll, an endless strip, a circular disc, and the like.

Exemplary polyimide substrate can include rapidly cured polyimide polymers, such as VTEC™ PI 1388, 080-051, 851, 302, 203, 201, and PETI-5, all available from Richard Blaine International, Incorporated, Reading, Pa. Also, other thermosetting polyimides that can be cured at temperatures of above 300° C. can include PYRE M.L® RC-5019, RC 5057, RC-5069, RC-5097, RC-5053, and RK-692, all commercially available from industrial Summit Technology Corporation, Parlin, N.J.; RP-46 and RP-50, both commercially available from Unitech LLC, Hampton, Va.; DURIMIDE® 100, commercially available from FUJIFILM Electronic Materials U.S.A., Inc., North Kingstown, R.I.; and KAPTON® HN, VN and FN, all commercially available from E.I. DuPont, Wilmington, Del.

Exemplary polyamideimide substrate that can be used in the intermediate transfer member can be VYLOMAX® HR-11NN (15 weight percent solution in N-methylpyrrolidone, $T_g$=300° C., and $M_w$=45,000), HR-12N2 [30 weight percent solution in N-methylpyrrolidone/xylene/methyl ethyl ketone (e.g., 50/35/15), $T_g$=255° C., and $M_w$=8,000], HR-13NX (30 weight percent solution in N-methylpyrrolidone/xylene of 67/33, $T_g$=280° C., and $M_w$=10,000), HR-15ET (25 weight percent solution in ethanol/toluene of 50/50, $T_g$=260° C., and $M_w$=10,000), HR-16NN (14 weight percent solution in N-methylpyrrolidone, $T_g$=320° C., and $M_w$=100,000), all commercially available from Toyobo Company of Japan, and TORLON® AI-10 ($T_g$=272° C.), commercially available from Solvay Advanced Polymers, LLC, Alpharetta, Ga.

Exemplary polyimides that are useful for the intermediate transfer member substrates can be prepared as fully imidized polymers, which do not contain any "amic" acid, and do not require high temperature cure to convert them to imide form.

In embodiments, the intermediate transfer member 200A-C or 150 in a film or belt configuration can have a circumference ranging from about 250 to about 2,500 millimeters, from about 1,500 to about 2,500 millimeters, or from about 2,000 to about 2,200 millimeters with a corresponding width of, for example, from about 100 to about 1,000 millimeters, from about 200 to about 500 millimeters, or from about 300 to about 400 millimeters.

Figure 3A:
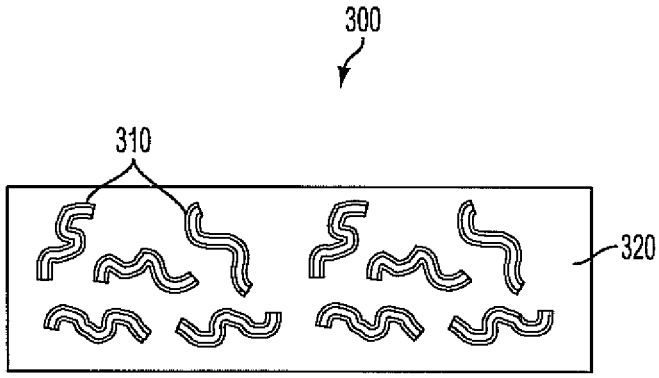
FIG. 3A depicts an exemplary composite material in accordance with various embodiments of the present teachings.

In embodiments, the outermost layer 250 of the intermediate transfer member 200A-C, 150 can include a composite material. FIG. 3A illustrates an exemplary composite material 300 in accordance with various embodiments of the present teachings. It should be readily apparent to one of ordinary skill in the art that the material 300 depicted in FIG. 3 represents a generalized schematic illustration and that other components/fillers/particles can be added or existing components/fillers/particles can be removed or modified.

As shown, the composite material 300 can include a plurality of fluoroelastomer-coated nanotubes 310 dispersed in a fluoroplastic polymer matrix 320. In various embodiments, the fluoroelastomer-coated nanotubes 310 can be dispersed randomly, uniformly, and/or spatially-controlled in the fluoroplastic polymer matrix 320.

As disclosed herein, the term "fluoroelastomer-coated nanotube" refers to a filler material that includes a core element having a shell layer over the core element. In various embodiments, the core element can be a hard core including carbon nanotubes (CNTs), while the shell layer can be a soft shell including one or more fluoroelastomers.

In various embodiments, the fluoroplastic matrix can be crystalline or semi-crystalline and can be "brittle". The incorporation of the fluoroelastomer-coated CNTs, for example, having a soft shell on a hard/stiff core, can be used to effectively toughen the brittle fluoroplastic matrix to provide a non-brittle composite material with desirable surface properties useful for the intermediate transfer member 150, 200A-C.

In embodiments, the fluoroplastic matrix can include one or more fluoroplastic materials including, but not limited to, a polymer having one or more monomeric repeat units selected from the group consisting of hexafluoropropylene, chlorotrifluoroethylene, perfluoro(methyl vinyl ether), perfluoro(ethyl vinyl ether), perfluoro(propyl vinyl ether), tetrafluoroethylene, hexafluoropropylene, vinylidene fluoride and mixtures thereof.

In embodiments, the fluoroplastic polymer can include, for example, TEFLON®-like materials such as, fluorinated ethylene propylene copolymer (FEP), polytetrafluoroethylene (PTFE), and/or polyfluoroalkoxy polytetrafluoroethylene (PFA TEFLON®). Other exemplary commercially available fluoroplastic polymers can include those fluoroplastics under various designations as THVP available from Dyneon (Oakdale, Minn.).

Figure 3B:
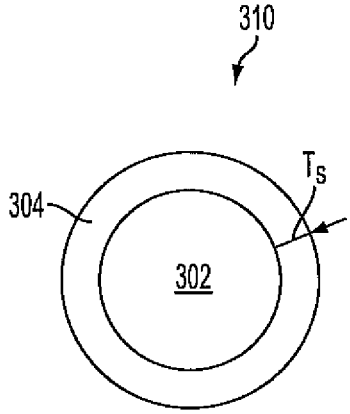
FIG. 3B depicts a cross-sectional schematic of an exemplary fluoroelastomer-coated nanotube in accordance with various embodiments of the present teachings.

FIG. 3B illustrates a cross-sectional schematic of an exemplary fluoroelastomer-coated nanotube 310 in accordance with various embodiments of the present teachings. As shown, the fluoroelastomer-coated nanotube 310 can include a carbon nanotube 302 surrounded by a soft fluoroelastomer shell 304.

As used herein and unless otherwise specified, the term "carbon nanotube" or "CNT" refers to an elongated carbon material that has at least one minor dimension, for example, width or diameter, of less than about 1000 nanometers. In various embodiments, the CNT can have an average diameter ranging from about 1 to about 1000 nanometers, or diameter ranging from about 1 to about 100 nanometers, or ranging from about 10 to about 50 nanometers.

In various embodiments, the carbon nanotubes can include, but are not limited to, carbon nanoshafts, carbon nanopillars, carbon nanowires, carbon nanorods, and carbon nanoneedles and their various functionalized and derivatized filler forms, which include carbon nanofibers with exemplary forms of thread, yarn, fabrics, etc. In one embodiment, the CNT can be considered as one atom thick layers of graphite, called graphene sheets, rolled up into nanometer-sized cylinders, tubes or other shapes.

In various embodiments, the carbon nanotubes or CNTs can include modified carbon nanotubes from all possible carbon nanotubes described above and their combinations. The modification of the carbon nanotubes can include a physical and/or a chemical modification.

In various embodiments, the carbon nanotubes or CNTs can include single wall carbon nanotubes (SWCNTs), multiwall carbon nanotubes (MWCNTs), and their various functionalized and derivatized filler forms such as carbon nanofibers, as exemplarily shown in FIG. 3A.

In various embodiments, the CNT can have an aspect ratio ranging from about 10 to about 1000, or from about 10 to about 5,000, or from about 5,000 to about 1,000,000. The high aspect ratio of CNTs can allow the fluoroelastomer-coated nanotube 310 to form long range cavitations around the fluoroelastomer shell layer and thus to effectively relieve stress at lower threshold loading in the plastic polymer matrix.

Note that although FIG. 3B illustrates a circular cross section for the exemplary CNT 302, however, one of ordinary skill in the art would understand that the CNT core element of the fluoroelastomer-coated CNT 310 can have various other cross sectional shapes, regular or irregular, such as, for example, a rectangular, a polygonal, or an oval shape. Accordingly, the CNT 302 or the resulting fluoroelastomer-coated CNT 310 can have, for example, cylindrical 3-dimensional shapes.

In embodiments, the fluoroelastomer soft shell 304 can include one or more fluoro-containing elastomers including, for example, fluoroelastomers, perfluoroelastomers, fluorosilicones, and mixtures thereof.

Examples of the fluoroelastomers can include copolymers, terpolymers and/or tetrapolymers of vinylidenefluoride, hexafluoropropylene, and tetrafluoroethylene, which are commercially known under various designations as VITON® A, VITON® E, VITON® E60C, VITON® E45, VITON® E430, VITON® B910, VITON® GH, VITON® B50, VITON® E45, and VITON® GF. The VITON® designation is a Trademark of E.I. DuPont de Nemours, Inc. Among those, exemplary fluoroelastomers can include (1) a class of copolymers of vinylidenefluoride, hexafluoropropylene, and tetrafluoroethylene, known commercially as VITON® A; (2) a class of terpolymers of vinylidenefluoride, hexafluoropropylene, and tetrafluoroethylene, known commercially as VITON® B; and (3) a class of tetrapolymers of vinylidenefluoride, hexafluoropropylene, tetrafluoroethylene, and a cure site monomer, such as VITON® GF, having 35 mole percent of vinylidenefluoride, 34 mole percent of hexafluoropropylene, and 29 mole percent of tetrafluoroethylene with 2 percent cure site monomer. The cure site monomer can also include those available from E.I. DuPont de Nemours, Inc., for example, 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomers.

In embodiments, the fluoroelastomer shell layer 304 can have a shell thickness $T_s$ on the outer surface of the CNT hard core 302. In various embodiments, the shell thickness $T_s$ can be at least about 1 nm in order to, for example, toughen the fluoroplastic polymer matrix when the fluoroelastomer-coated CNTs are dispersed in the polymer matrix. In embodiments, the shell thickness $T_s$ can be in a range from about 1 to about 5,000 nanometers, or from about 1 to about 2,000 nanometers, or from about 1 to about 1000 nanometers.

In various embodiments, the fluoroelastomer shell layer 304 can be attached to the CNT hard core 302 by physical or chemical bonds. For example, fluoroelastomers can chemically react or physically interact with CNTs or modified CNTs through functional groups including, but not limited to, hydroxyl, carboxylic acid, aziridine, azomethine ylide, aryl diazonium cation, oxazolidinone, and mixtures thereof.

In various embodiments, the fluoroelastomer-coated CNTs 310 can be dispersed in the fluoroplastic polymer matrix 320 having a weight loading, for example, from about 0.5% to about 20%, or from about 0.5% to about 15%, or from about 5% to about 10% by weight of the fluoroplastic polymer matrix 320, although other amount of the fluoroelastomer-coated CNTs can be used to form the composite material 300.

In various embodiments, the fluoroelastomers used in the fluoroelastomer-coated CNTs can be present in an amount of from about 0.5% to about 10%, or from about 1% to about 9%, or from about 2% to about 6% by weight of the fluoroplastic polymer matrix 320. Other possible amount of fluoroelastomers can also be used to form the composite outermost layer of the disclosed intermediate transfer member in accordance with various embodiments of the present teachings.

In embodiments, the composite material 300 can be formed by, for example, blending CNTs 302, fluoroelastomer(s) 304 along with corresponding curing agent(s), and fluoroplastic polymer(s) to form a coating composition.

In various embodiments, other filler materials, for example, inorganic particles, can be used for the coating composition and the subsequently formed composite material. In various embodiments, exemplary inorganic particles can include, for example, metal oxides, non-metal oxides, and metals. Specifically, the metal oxides can include, for example, silicon oxide, aluminum oxide, chromium oxide, zirconium oxide, zinc oxide, tin oxide, iron oxide, magnesium oxide, manganese oxide, nickel oxide, copper oxide, antimony pentoxide, and indium tin oxide. The non-metal oxides can include, for example, boron nitride, and silicon carbides (SiC). The metals can include, for example, nickel, copper, silver, gold, zinc, and iron. In various embodiments, other additives known to one of ordinary skill in the art can also be included to form the disclosed composite materials.

In embodiments, the coating composition can also be prepared in an effective solvent in order to disperse carbon nanotubes, fluoroelastomeric polymers and/or corresponding curing agents; fluoroplastic polymers, and optionally, inorganic filler particles.

The effective solvent can be water and/or organic solvents including, but not limited to, methyl isobutyl ketone (MIBK), acetone, methyl ethyl ketone (MEK), and mixtures thereof. Other solvents that can form suitable dispersions can be within the scope of the various embodiments of the present teachings.

In certain embodiments, the coating composition can include carbon nanotubes, VITON® fluoroelastomers and its curing agent (e.g., a bisphenol curing agent VC-50), fluoroplastics, and optionally, inorganic fillers (e.g., MgO) in an organic solvent (e.g., MIBK).

In a specific embodiment, the coating composition can be prepared by first shear-mixing VITON® and CNTs, which can then be mixed with an exemplary fluoroplastic THVP210, a polymer including tetrafluoroethylene, hexafluoropropylene and vinylidene fluoride from Dyneon (Oakdale, Minn.). The resultant mixture can further be mixed with a curing agent, e.g. VC 50, and metal oxide MgO in the organic solvent MIBK.

In embodiments, the formed coating composition can then be coated on a suitable substrate and solidified to form a plurality of fluoroelastomer-coated CNTs 310 dispersed in a fluoroplastic matrix 320 as shown in FIG. 3A. During this formation, the fluoroelastomer-coated CNTs 310 can be formed, as disclosed herein, by physically or chemically attaching the fluoroelastomers 304 onto each carbon nanotube 302 in a core-shell manner.

In various embodiments, the coating composition can be coated on a material or a surface using, for example, a coating technique, an extrusion technique and/or a molding technique. Exemplary coating techniques can include dip coating, painting, brush coating, roller coating, pad application, spray coating, spin coating, casting, and/or flow coating.

In various embodiments, the solidification of the coated coating composition can include a curing process depending on the fluoroelastomers and fluoroplastics used. In embodiments, prior to the curing process, the coating composition can be partially or wholly evaporated or dried for a length of time. The subsequent curing process can be determined by the polymer(s) and the curing agent(s) used and can include, for example, a step-wise curing process, although any curing schedules known to one of ordinary skill in the art can be within the scope of embodiments herein.

In various embodiments, the composite material 300 including the fluoroelastomer-coated CNTs 310 dispersed in the fluoroplastic polymer matrix 320 can provide certain advantages to the intermediate transfer member 150, 200A-C.

For example, the CNT hard cores can provide exceptional mechanical support to the fluoroelastomer-coated CNTs and thus to the composite material. When brittle fluoroplastic materials are used, the addition of the fluoroelastomer-coated CNT fillers can improve fracture toughness of the brittle fluoroplastics but without negatively impacting the modulus of the toughened fluoroplastics. In addition, the CNT hard cores can also provide the composite material with desirable electrical (e.g., conductivity), and thermal (e.g., conductivity) functions required by various specific applications.

The resultant composite material can thus provide desirable surface properties useful for the intermediate transfer layer for forming images. These surface properties can include electrical, thermal and mechanical properties and can be tunable due to the composition flexibilities, and crosslinking levels of the fluoroelastomers.

In embodiments, the outermost layer 250 of the intermediate transfer member 150, 200A-C (see FIGS. 1 and 2A-2C) can have a tunable low surface energy, for example, of about 25 mN/m or less, or ranging from about 18 mN/m to about 25 mN/m, or ranging from about 20 mN/m to about 24 mN/m. The low surface energy can provide low adhesion to toner materials during the image formation and can facilitate efficient image transfer and cleaning processes.

In embodiments, the outermost layer 250 of the intermediate transfer member 150, 200A-C (see FIGS. 1 and 2A-2C) can have a tunable surface resistivity of at least about $10^9$ ohms/sq, or ranging from about $10^9$ ohms/sq to about $10^{13}$ ohms/sq, or ranging from about $10^{10}$ ohms/sq to about $10^{12}$ ohms/sq.

In embodiments, the outermost layer 250 of the intermediate transfer member 150, 200A-C (see FIGS. 1 and 2A-2C) can have a tunable bulk resistivity of at least about $10^{12}$ ohm·cm, or from about $10^{8}$ ohm·cm to about $10^{12}$ ohm·cm, or from about $10^{9}$ ohm·cm to about $10^{11}$ ohm·cm.

In embodiments, the outermost layer 250 of the intermediate transfer member 150, 200A-C (see FIGS. 1 and 2A-2C) can have a tunable mechanical Young's modulus of at least about 2000 MPa, or ranging from about 2500 MPa to about 8500 MPa, or greater than 8500 MPa.

In embodiments, the outermost layer 250 of the intermediate transfer member 150, 200A-C (see FIGS. 1 and 2A-2C) can have a thickness ranging from about 1 to about 150 micron, or thickness ranging from about 2 to about 50, or thickness ranging from about 5 to about 40.

In embodiments, conductive component, such as a carbon black, a polyaniline or a metal oxide, can be present in one or more of the intermediate transfer member substrate, the resilient layer and the outermost layer, for example, in an amount of from about 1 to about 60 weight percent, from about 5 to about 40 weight percent, or specifically from about 10 to about 30 weight percent based on the total weight of the corresponding layer.

In embodiments, carbon black surface groups can be formed by oxidation with an acid or with ozone, and where there can be absorbed or chemisorbed oxygen groups selected from, for example, carboxylates, phenols, and the like. The carbon surface can be essentially inert to most organic reaction chemistry except primarily for oxidative processes and free radical reactions.

In embodiments, the conductivity of carbon black can be dependent on surface area and its structure primarily. Generally, the higher the surface area and the higher the structure, the more conductive is the carbon black. Surface area can be measured by the known B.E.T. nitrogen surface area per unit weight of carbon black, and is the measurement of the primary particle size. Structure can be a complex property that refers to the morphology of the primary aggregates of carbon black. It can be a measure of both the number of primary particles including primary aggregates, and the manner in which they can be "fused" together. High structure carbon blacks can be characterized by aggregates that include many primary particles with considerable "branching" and "chaining", while low structure carbon blacks can be characterized by compact aggregates that include fewer primary particles. Structure can be measured by dibutyl phthalate (DBP) absorption by the voids within carbon blacks. The higher the structure, the more the voids, and the higher the DBP absorption.

Examples of carbon blacks selected as the conductive component for the intermediate transfer member can include VULCAN® carbon blacks, REGAL® carbon blacks, MONARCH® carbon blacks and BLACK PEARLS® carbon blacks available from Cabot Corporation. Specific examples of conductive carbon blacks can be BLACK PEARLS® 1000 (B.E.T. surface area=343 $m^2/g$, DBP absorption=−1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area=35 $m^2/g$, DBP absorption=1.22 ml/g), VULCAN® XC72 (B.E.T. surface area=254 $m^2/g$, DBP absorption=1.76 ml/g), VULCAN® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL® 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers); Channel carbon blacks available from Evonik-Degussa; Special Black 4 (B.E.T. surface area=180 $m^2/g$, DBP absorption=1.8 ml/g, primary particle diameter=25 nanometers), Special Black 5 (B.E.T. surface area=240 $m^2/g$, DBP absorption=1.41 ml/g, primary particle diameter=20 nanometers), Color Black FW1 (B.E.T. surface area=320 $m^2/g$, DBP absorption=2.89 ml/g, primary particle diameter=13 nanometers), Color Black FW2 (B.E.T. surface area=460 $m^2/g$, DBP absorption=4.82 ml/g, primary particle diameter=13 nanometers), and Color Black FW200 (B.E.T. surface area=460 $m^2/g$, DBP absorption=4.6 ml/g, primary particle diameter=13 nanometers).

In embodiments, exemplary polyaniline conductive component selected can have a relatively small particle size of, for example, from about 0.5 microns to about 5 microns, from about 1.1 microns to about 2.3 microns, from about 1.2 microns to about 2 microns, from about 1.5 microns to about 1.9 microns, or about 1.7 microns. Specific examples of polyanilines selected for the intermediate transfer member can include PANIPOL™ F, commercially available from Panipol Oy, Finland; and lignosulfonic acid grafted polyaniline.

Examples of metal oxides selected as a conductive component for the intermediate transfer member can include tin oxide, antimony doped tin oxide, indium oxide, indium tin oxide, zinc oxide, and/or titanium oxide.

The following examples are illustrative of the present teachings and the advantageous properties, and are not to be taken as limiting the disclosure or claims in any way. In this example, as well as elsewhere in this application, all parts and percentages are by weight unless otherwise indicated.

EXAMPLES

Example 1

Preparation of THVP/2% CNT/VITON® Composite

About 12 parts of multi-walled carbon nanotubes and about 88 parts of VITON® GF (available from E.I. du Pont de Nemours, Inc., Wilmington, Del.) as a shell elastomer were placed in a Haake Rheomix mixer (Thermo Scientific, Waltham, Mass.), and compounded at a rotor speed of about 20 rpm for about 30 minutes to form a nanotube master batch containing about 12 weight % of multi-walled carbon nanotubes dispersed in VITON® GF. About 13 parts of the resulted carbon nanotube master batch were then compounded with 67 grams of a fluoro-plastic of THVP221 from Dyneon (Oakdale, Minn.) at about 80° C. in the Haake Rheomix at a rotor speed of 20 rpm for about 30 minutes to form a polymer blend containing about 2 weight percent of carbon nanotubes covered by the VITON® elastomer shell.

The THVP/CNT/VITON® blend (about 4.18 Parts) was mixed with the metal oxides (about 0.787 part of magnesium oxide and about 0.393 part of calcium hydroxide), and about 1.68 parts of the bisphenol VC-50 curing agent (VITON® Curative No. 50 available from E.I. du Pont de Nemours, Inc.) in methyl isobutyl ketone (about 28.4 parts). The resulted coating composition was then cast in a mold. The resulting film after solvent evaporation was cured at ramp temperatures of about 149° C. for about 2 hours, about 177° C. for about 2 hours, about 204° C. for about 2 hours and about 232° C. for about 6 hours for a post cure.

Example 2

Preparation of THVP/3% CNT/VITON® Composite

A polymer composite coating containing about 3 weight percent of carbon nanotubes shelled by a VITON® elastomer was prepared following the procedure described in Example 1, except that about 20 parts of carbon nanotube master batch and about 60 parts of THVP221 were used to make the THVP/3% CNT/VITON® composite blend. The THVP/CNT/VITON® composite blend (about 4.225 Parts) was then mixed with metal oxides (about 0.787 part of magnesium oxide and about 0.393 part of calcium hydroxide), and about 1.9 parts of the bisphenol VC-50 curing agent (VITON® Curative No. 50 available from E.I. du Pont de Nemours, Inc.) in methyl isobutyl ketone (about 28.5 parts) to form a coating composition, which was then cast in a mold. The resulting film after solvent evaporation was cured at ramp temperatures of about 149° C. for about 2 hours, about 177° C. for about 2 hours, about 204° C. for about 2 hours and of about 232° C. for about 6 hours for a post cure.

Example 3

Comparative Example-1

Preparation of THVP Plastic Film

The THVP coating composition was prepared by mixing the THVP221 (about 4.10 parts), metal oxides (about 0.787 part of magnesium oxide and about 0.393 part of calcium hydroxide), and the bisphenol VC-50 curing agent (about 1.68 parts, VITON® Curative No. 50 available from E.I. du Pont de Nemours, Inc.) in methyl isobutyl ketone (about 27.5 parts). The coating composition was then cast in a mold. The resulting film after solvent evaporation was cured at ramp temperatures of about 149° C. for about 2 hours, about 177° C. for about 2 hours, about 204° C. for about 2 hours and of about 232° C. for about 6 hours for a post cure. In this manner, the comparative Example-1 of the plastic film included the fluoro-plastic matrix but no VITON® elastomers or carbon nanotubes involved as compared with Examples 1-2.

Example 4

Comparative Example-2

Preparation of THVP/VITON® Composite

THVP/VITON® coating composition was prepared following the procedure described in Example 1, except that about 68 grams of THVP221 and about 12 grams of VITON® GF pellets GF (available from E.I. du Pont de Nemours, Inc.) were used with no carbon nanotubes involved. Such coating composition was cast into a film following the procedure described in Examples 3. In this manner, the comparative Example-2 included the fluoro-plastic matrix having VITON® elastomers dispersed therein.

Example 5

Mechanical Properties

Each cured composite film of Examples 1-4 was cut into a number of specimens that were then subjected to a mechanical test and averaged for each example of Examples 1-4. The mechanical test was performed using ASTM D412 Tensile Properties of Elastomers (Thomson Scientific, Chicago, Ill.). The results were summarized in Table 1 as following.

TABLE 1

| Examples | Film Thickness (mil) | Tensile stress (Psi) | Tensile strain (%) | Modulus (Young's) (Psi) | Toughness |
|---|---|---|---|---|---|
| Example-1 | 13.7 | 955.6 | 142.1 | 1740.1 | 806.3 |
| Example-2 | 17.6 | 1223.8 | 158.5 | 4397.5 | 1283.0 |
| Comparative Example-1 | 14.8 | 327.7 | 136.9 | 928.7 | 332.7 |
| Comparative Example-2 | 13.2 | 499.2 | 163.2 | 1044.6 | 546.5 |

As indicated by Table 1, the composite coatings (see Examples 1-2) including core-shell nano-fillers, i.e., including soft fluoroelastomer-coated CNTs, can be significantly improved in both young's modulus and mechanical toughness as compared with the composites (see Comparative Examples 1-2) that do not include the disclosed core-shell nano-fillers.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An intermediate transfer member comprising:

a substrate; and an outermost layer disposed over the substrate and an adhesive layer between the substrate and the outermost layer, wherein the outermost layer comprises a fluoroplastic matrix and a plurality of fluoroelastomer-coated carbon nanotubes dispersed in the fluoroplastic matrix, wherein each of the plurality of fluoroelastomer-coated carbon nanotubes comprises a carbon nanotube surrounded by a fluoroelastomer shell, each of the plurality of fluoroelastomer-coated carbon nanotubes comprising a fluoroelastomer present in an amount ranging from about 0.5% to about 10% by weight of the total fluoroplastic matrix, wherein the outermost layer has a surface resistivity ranging from about $10^9$ ohms/sq to about $10^{13}$ ohms/sq, and wherein the Young's modulus of the outermost layer is adjusted to be at least about 2000 MPa.

2. The member of claim 1, wherein the outermost layer has a surface energy of less than about 25 mN/m.

3. The member of claim 1, wherein the outermost layer has a thickness ranging from about 1 micron to about 150 microns.

4. The member of claim 1, wherein the fluoroplastic matrix comprises a fluoroplastic polymer comprising one or more monomeric repeat units selected from the group consisting of tetrafluoroethylene, vinylidene fluoride, hexafluoropropylene, chlorotrifluoroethylene, perfluoro(methyl vinyl ether), perfluoro(ethyl vinyl ether), perfluoro(propyl vinyl ether), and mixtures thereof.

5. The member of claim 1, wherein the fluoroelastomer shell comprises a monomeric repeat unit selected from the group consisting of a vinylidene fluoride, a hexafluoropropylene, a tetrafluoroethylene, and mixtures thereof.

6. The member of claim 1, wherein the fluoroelastomer shell has a thickness of at least about 1 nanometer.

7. The member of claim 1, wherein the carbon nanotube comprises an aspect ratio ranging from about 10 to about 5000.

8. The member of claim 1, wherein the fluoroelastomer shell further comprises a functional group capable of bonding with the carbon nanotube; wherein the functional group is selected from the group consisting of hydroxyl, carboxylic acid, aziridine, azomethine ylide, aryl diazonium cation, oxazolidinone, and a combination thereof.

9. The member of claim 1, wherein the substrate of the intermediate transfer member is formed of a material selected from the group consisting of polyimide, polyamideimide, polyetherimide, and a combination thereof.

10. The member of claim 1, wherein the intermediate transfer member is in a form selected from the group consisting of a sheet, a film, a web, a foil, a strip, a coil, a cylinder, a drum, a drelt, a roll, an endless strip, a circular disc, and a belt.

11. The member of claim 1 further comprising one or more functional layers disposed between the substrate and the outermost layer, wherein the one or more functional layers comprise a silicone selected from the group consisting of a fluorosilicone, a silicone rubber and a mixture thereof.

12. An intermediate transfer member comprising:

a substrate comprising polyimide; and an outermost layer disposed over the substrate and an adhesive layer between the substrate and the outermost layer, wherein the outermost layer comprises a plurality of fluoroelastomer-coated carbon nanotubes dispersed in a fluoroplastic matrix to provide the outermost layer a surface energy of less than about 25 mN/m, wherein each of the plurality of fluoroelastomer-coated carbon nanotubes comprises a carbon nanotube surrounded by a fluoroelastomer shell, wherein each of the plurality of fluoroelastomer-coated carbon nanotubes comprises a fluoroelastomer present in an amount ranging from about 0.5% to about 10% by weight of the total fluoroplastic matrix, and wherein the Young's modulus of the outermost layer is adjusted to be at least about 2000 MPa.

13. The member of claim 12, wherein the outermost layer has a surface resistivity ranging from about $10^9$ ohms/sq to about $10^{13}$ ohms/sq and a bulk surface resistivity ranging from about $10^8$ ohms·cm to $10^{12}$ ohms·cm.

14. The member of claim 12, wherein the fluoroelastomer shell has a thickness of at least about 1 nanometer, wherein the carbon nanotube has an aspect ratio ranging from about 10 to about 5000 and the fluoroelastomer shell comprises a monomeric repeat unit selected from the group consisting of a vinylidene fluoride, a hexafluoropropylene, a tetrafluoroethylene, and mixtures thereof.

15. An image forming apparatus comprising:

an intermediate transfer member comprising:

a substrate; and an outermost layer disposed over the substrate and an adhesive layer between the substrate and an outermost layer, wherein the outermost layer comprises a plurality of fluoroelastomer-coated carbon nanotubes dispersed in a fluoroplastic matrix to provide a surface resistivity ranging from about $10^9$ ohms/sq to about $10^{13}$ ohms/sq and a surface energy of less than about 25 mN/m, wherein each of the plurality of fluoroelastomer-coated carbon nanotubes comprises a carbon nanotube surrounded by a fluoroelastomer shell, wherein each of the plurality of fluoroelastomer-coated carbon nanotubes comprises a fluoroelastomer present in an amount ranging from about 0.5% to about 10% by weight of the total fluoroplastic matrix, and wherein the Young's modulus of the outermost layer is adjusted to be at least about 2000 MPa; and an imaging member disposed to allow the intermediate transfer member to transfer a developed toner image from the imaging member to a print medium.

16. The apparatus of claim 15, wherein the Young's modulus of the outermost layer is within the range of from about 2500 MPa to about 8500 MPa.

17. The apparatus of claim 15, wherein the fluoroelastomer shell has a thickness of at least about 1 nanometer, wherein the carbon nanotube has an aspect ratio ranging from about 10, to about 5000 and the fluoroelastomer shell comprises a monomeric repeat unit selected from the group consisting of a vinylidene fluoride, a hexafluoropropylene, a tetrafluoroethylene, and mixtures thereof.

* * * * *